United States Patent [19]

Christensen

[11] 4,015,661

[45] Apr. 5, 1977

[54] APPARATUS FOR COUPLING AND UNCOUPLING PIPE SECTIONS

[76] Inventor: John L. Christensen, 906 11th St. SE., Rochester, Minn. 55901

[22] Filed: Mar. 15, 1976

[21] Appl. No.: 667,024

[52] U.S. Cl. ..... 166/77.5; 81/57.18

[51] Int. Cl.[2] ..... E21B 33/03

[58] Field of Search ..... 166/77.5; 81/57.15, 81/57.18, 57.33, 57.34, 57.35, 128

[56] References Cited

UNITED STATES PATENTS

| | | | |
|---|---|---|---|
| 1,200,612 | 10/1916 | Helm | 81/57.18 |
| 3,147,652 | 9/1964 | George | 81/57.18 |
| 3,793,913 | 2/1974 | Wilms | 81/57.18 |
| 3,847,040 | 11/1974 | Bufkin | 81/57.18 |
| 3,875,826 | 4/1975 | Drefuss et al. | 81/57.18 |

*Primary Examiner*—James A. Leppink
*Attorney, Agent, or Firm*—Mark W. Gehan

[57] ABSTRACT

Apparatus is described for coupling and uncoupling pipe sections at the top or head of a well casing. The apparatus comprises (a) a base adapted to support a platform over a well head, the platform having an opening therein, (b) a plurality of self-engaging clamps supported on the platform around said opening, the clamps being adapted to permit upward movement of pipe sections through said opening and being further adapted to prevent downward movement of pipe sections and rotational movement of a pipe coupling, (c) drive gear retaining means, above said base and platform, said retaining means being supported in such a manner that axial movement with respect to the platform is restricted while vertical movement is permitted, (d) drive gear means aligned over said opening in the platform and supported by the retaining means, said gear means being adapted to grip a pipe section and turn it into or out of a pipe coupling, and (e) power means for turning said drive gear means.

9 Claims, 6 Drawing Figures

APPARATUS FOR COUPLING AND UNCOUPLING PIPE SECTIONS

BACKGROUND OF THE INVENTION

This invention relates to apparatus for facilitating the engagement and disengagement of pipe sections.

With a typical well (e.g. a water well) in which pipe extends from near ground level down into a hole inside a casing it is sometimes necessary to remove the pipe from inside the casing in order to effect repairs or replacements of pipe sections. Thus, for such repairs it is necessary to incrementally lift the pipe out of the casing with a crane or suitable derrick and disconnect the individual pipe sections (which are connected to one another by means of conventional threaded couplings).

However, it is very difficult to disconnect individual pipe sections from one another, especially when the pipe has been in the well for a considerable time and the couplings are rusted onto the pipe sections. Consequently, in order to disconnect the pipe sections from one another considerable effort and time have been required, especially when using only manually operated tools. The present invention provides a powered device which quickly, safely, and efficiently connects and disconnects pipe sections.

SUMMARY OF THE INVENTION

In accordance with the present invention there is provided apparatus for coupling and uncoupling pipe sections at the head of a well casing, wherein the apparatus comprises:

a. a base member adapted to support a platform over the top of a well, the platform having an opening therein which is adapted to permit the pipe sections to pass therethrough;

b. a plurality of self-engaging clamps supported on the platform around the periphery of, and projecting slightly over, said opening, said clamps being supported in a manner such that force exerted upwardly thereagainst by a pipe coupling in said opening effects disengagement of said clamps with respect to said pipe coupling but force exerted downwardly against said clamps will effect self-engagement thereof with respect to the periphery of said pipe coupling to prevent further downward movement, and rotational movement, of said coupling;

c. means for preventing sefl-engagement of said clamps with respect to said pipe coupling;

d. drive gear retaining means above said base and platform, said retaining means being supported in such a manner that rotational movement with respect to said platform is restricted while upward vertical movement is permitted, e. drive gear means supported by said retaining means, said gear means being aligned over said opening in said platform, said gear means having a plurality of gripping arms in the center thereof adapted to grip a pipe section therein and cause rotational movement of said pipe section with respect to said coupling;

f. power means operatively associated with said drive gear means for effecting rotational movement thereof.

Thus, the apparatus of the invention is adapted to both (1) grip a pipe coupling in a manner such that downward movement, and rotational movement (i.e., turning), are restricted or prevented, and (2) grip a pipe section firmly and cause it to be turned into or out of the coupling (depending upon whether it is desired to connect or disconnect pipe sections). Since the apparatus of the invention is operated by a power source (e.g. an electric motor) it is possible to connect or disconnect pipe sections very quickly and safely.

DETAILED DESCRIPTION OF THE INVENTION

The invention is described in more detail hereinafter with reference to the accompanying drawings wherein like reference characters refer to the same parts throughout the several views and in which.

Figure 1:
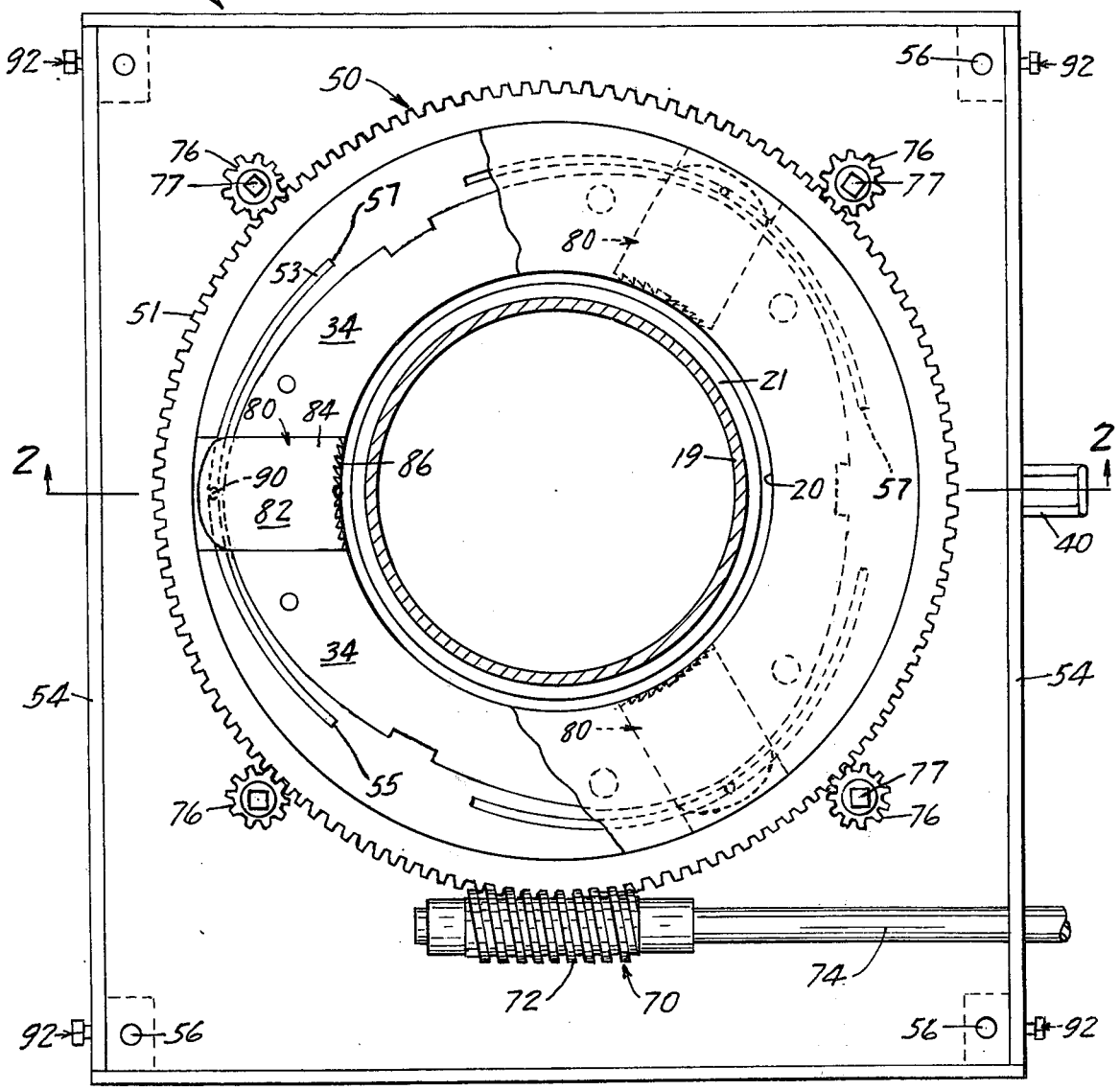
FIG. 1 is a top, partial cut-away, view of a preferred embodiment of the apparatus of the invention.

Thus in FIGS. 1–6 there is shown apparatus 10 which comprises a base member 12 adapted to support a platform 16. Base 12 has legs or upright members 14 which are suitably spaced apart so that the apparatus may be placed or positioned over the head of a well casing 18. If desired there may be just two legs 14 which are parallel to each other and extend along opposite side edges of the apparatus, or there may be several legs. If desired, the base and the legs may be integral with the platform 16.

Platform 16, as shown in the drawings, is supported horizontally on base 12 and is typically a metal plate having a circular hole or opening 20 therein which is slightly larger than the pipe sections 19 and pipe couplings 21 which are to pass through it. For example, if the apparatus is to be used to couple or uncouple pipe having a diameter of ten inches, the opening 20 is preferably about 12 inches in diameter so as to permit pipe sections and pipe couplings to pass through it during proper operation of the apparatus. Preferably platform 16 has two similar sections which may be lifted out from the device, each section having a semi-circular cut-out along one edge. Thus, the two platform sections may be properly placed next to each other on the base 12 to form opening 20 when a pipe section may be protruding out of the casing.

A plurality of self-engaging clamps 22 are supported on platform 16 around the periphery of hole 20. Clamps 22 project slightly over the hole and are supported in such a manner that they do not restrict upward movement of pipe sections and couplings through the apparatus (e.g. when hoisting pipe sections out of the casing). However, the clamps 22 are also adpated to be self-engaging with respect to a pipe coupling when a pipe section is lowered through hole 20.

Preferably clamps 22 are pivotably mounted at their rearward portions 24 so that when a pipe section (having a coupling thereon) is lifted out of the casing the coupling will urge against the front or projecting lip 28 of each clamp and will cause the forward portion 26 of the clamps to swing upward and away from the coupling. Consequently, the clamps 22 do not interfere with upward movement of pipe sections.

However, when a pipe section is lowered through the hole 20 the front or projecting lip 28 of each clamp is adapted to catch against the underside of a pipe coupling, whereby teeth 30 on the forward portion 26 of the clamps are forced tightly against the periphery of the pipe coupling. Consequently, the clamps prevent further downward movement, and rotational movement, of the pipe coupling. Blocks 32 and 32*a*, disposed on three sides of each clamp 22 and anchored to platform 16, offer lateral support to clamps 22. Thus, the pipe coupling is then held firmly while the drive gear means (described in more detail hereinafter) turns a pipe section into, or out of, the coupling.

When it is desired to lower a pipe section, having a coupling threaded thereon, through platform 16 and into the casing it is necessary to disengage clamps 22. This may be accomplished simply by pivoting the clamps upwardly whereby they also move slightly away from the periphery of the hole 20 so as not to self-engage with the pipe coupling. Means for accomplishing this result, as shown in the drawings, comprises movable lever 40 having arms 42 and 44 projecting under platform 16. Each of the arms 42 and 44 is adapted to be raised, from a normally downward position, by downward motion of lever 40. When arms 42 and 44 are caused to be raised they in turn cause upward movement of plates 46 and 48 (which are each hingably supported at one of their ends under platform 16), and plates 46 and 48 cause upward movement of the front portions 26 of clamps 22 via pins extending through platform 16 to the underside of said clamps. Of course, the means for preventing self-engagement of clamps 22 may be entirely manual (e.g. the operator of the apparatus may simply move clamps 22 out of the way when it is desired to lower a pipe section through hole 20).

Drive gear means 50 is supported above platform 16 in gear retaining means or frame 54. Frame 54 is supported over platform 16 in such a manner that rotational movement of said frame with respect to the platform is restricted while upward vertical movement is permitted. This is accomplished in one embodiment by means of vertically projecting rods 56 which are anchored at one end to platform 16. Preferably one rod is located at each corner of platform 16. Frame 54 then has a complementary recess or slot 58 at each corner which is adapted to mate with a rod 56. Spacing means 60 is disposed over rods 56 to maintain frame 54 at a minimum distance above platform 16 (i.e., by preventing frame 54 from sliding completely down rods 56). Spacing means 60 may comprise an integral frame, as shown in the drawings, so that stress exerted on the rods and spacing means is equalized.

Frame means 54 has a circular recess therein which is adapted to receive drive gear means 50. At the bottom of the recess there is preferably a plate 62 having a circular opening therein of approximately the same size as opening 20 in platform 16 and in alignment therewith. Preferably, drive gear means 50 is separated from plate 62 by means of ball bearings 64 so as to minimize friction and wear between plate 62 and gear 50.

Frame means 54 also supports means 70 by which drive gear 50 is operatively associated with power means (not shown). Means 70 preferably comprises worm gear 72 on shaft 74. Conventional power means, for example, an electric motor or gasoline engine, is operatively connected to shaft 74 in a conventional manner, e.g. through a conventional gear box, thereby supplying power to worm gear 72, which in turn effects rotation of drive gear 50. Guide wheels or idler gears 76 on shafts 77, also supported by frame 54, prevent drive gear 50 from undesirably binding in frame 54 as it is turned by worm gear 72. If desired, one or more of the shafts 77 (on which guide wheels 76 are located) may be square in cross-section and may project slightly upward from guide wheels 76 so that a conventional wrench may be fitted thereover. The wrench may then be turned manually in order to assist the conventional power means in loosening pipe sections which are tightly rusted onto couplings.

Figure 5:
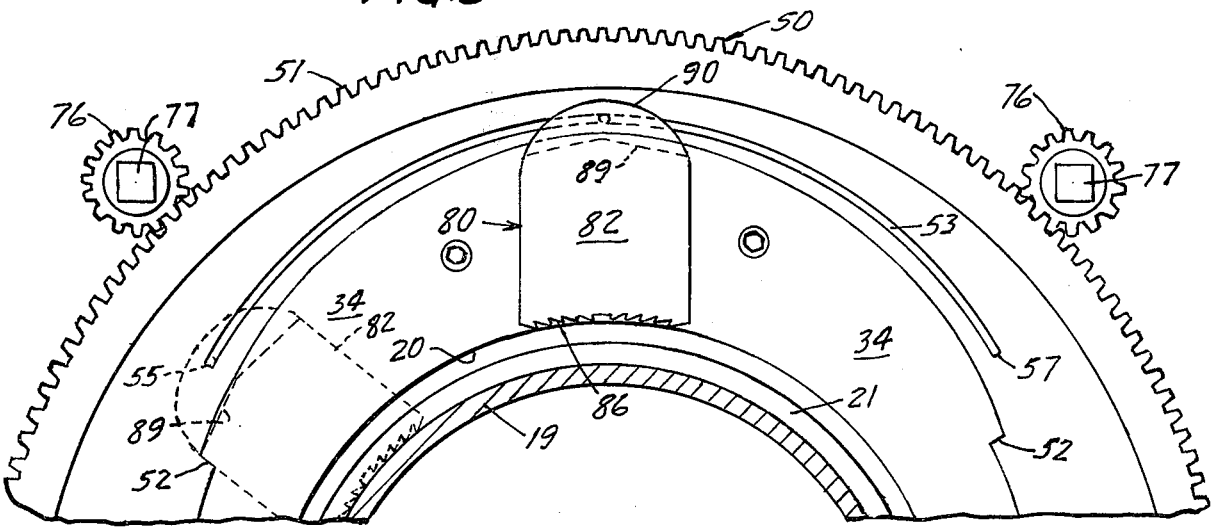
FIG. 5 is an enlarged view of a portion of the apparatus shown in FIG. 1.
Figure 2:
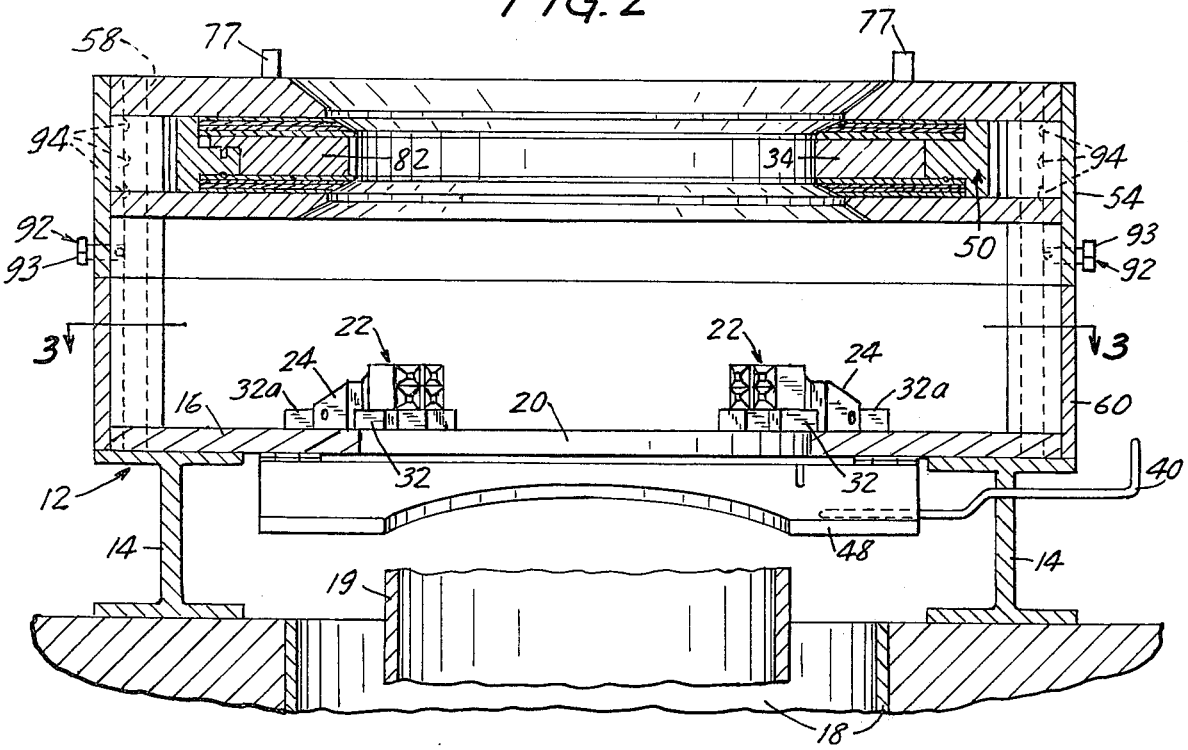
FIG. 2 is a cross-sectional view of the apparatus of FIG. 1 taken along line 2—2.

As shown in FIGS. 1, 2 and 5, a preferred embodiment of drive gear means 50 comprises a circular gear having a plurality of teeth 51 around its periphery which are adapted to mate with, and be driven by, worm gear 72. Drive gear means 50 has an opening in the center thereof which is sufficiently large to permit pipe sections and pipe couplings to pass through it.

Around the periphery of the central opening are positioned a plurality of gripping arms or dogs 80 which are adapted to move slightly into the opening and tightly grip a pipe section therein. Then with rotational movement of gear means 50 (supplied by worm gear 72 which is driven by conventional power means) the pipe section is accordingly also forced to turn. Depending upon the direction of movement of gear means 50, a pipe section may be turned into, or out of, a pipe coupling which is secured by clamps 22 on platform 16.

In the embodiment shown in FIGS. 1, 2 and 5 there are three gripping arms or dogs 80 spaced equidistantly around the periphery of the central opening in gear means 50. If desired, more or fewer gripping arms may be used, but the use of three gripping arms is preferred.

Each gripping arm or dog 80 comprises a body portion 82, a front portion or face 84 which has a plurality of teeth 86 thereon, and a rearward portion 88 which has follower means 90 thereon by which the rearward portion of gripping arm 80 is operatively connected to guide means 53 in gear means 50. Follower means 90 typically comprises a pin or projection which rests in guide means 53 (which is typically a slot or groove defining a curved path in gear means 50).

Because guide means 53 defines a curved path, and because follower means 90 rests in guide means 53, gripping arm 80 can be caused to move inwardly against a pipe section or outwardly away from a pipe section. Thus, when drive gear means 50 is turned counterclockwise, follower means 90 travels along the curve of guide means 53 until it reaches one end 55 thereof, at which point the teeth 86 on the front portion of gripping arm 80 are forced tightly against a pipe section, and the drive gear means 50 and gripping arms 80 then operate as a unit to cause the pipe section to be turned counterclockwise. The force provided by drive gear means 50 is exerted against the back end or face 89 of gripping arm 80 and not against the follower means 90 (because follower means 90 simply serves to provide the proper relative position of gripping arm 80 with respect to a pipe section). Thus, when gripping arm 80 is positioned at one end of the curved guide means, the back face 89 of the gripping arm 80 rests against the inside face 52 of drive gear 50 and the teeth 86 on the front portion of gripping arm 80 are forced tightly against the pipe section.

Then, when drive gear 50 is turned clockwise and follower means 90 moves along curved guide means 53 until it reaches the mid-point of the curve, the gripping arms 80 are moved completely away from the pipe section. Upon further rotation of drive gear 50 in a clockwise manner, the follower means 90 moves to end 57 of the guide means, at which point the teeth 86 on the gripping arm are again forced tightly against the pipe section, and the drive gear 50 and gripping arms operate as a unit to cause the pipe section to be turned clockwise. Other designs for the drive gear to achieve the same result will be apparent to those skilled in the art.

Figure 4:
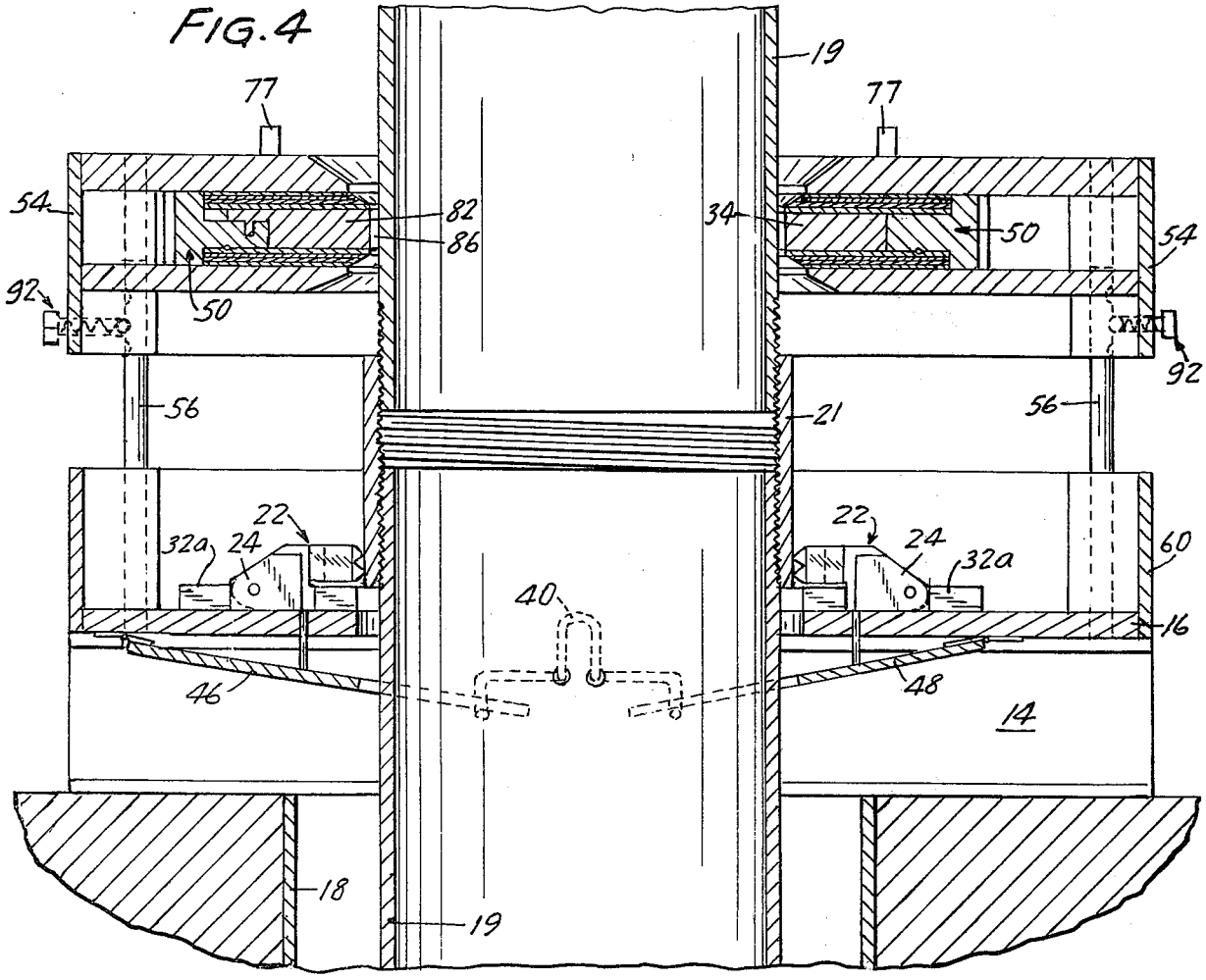
FIG. 4 is a longitudinal center section of the apparatus of the invention during operation.
Figure 3:
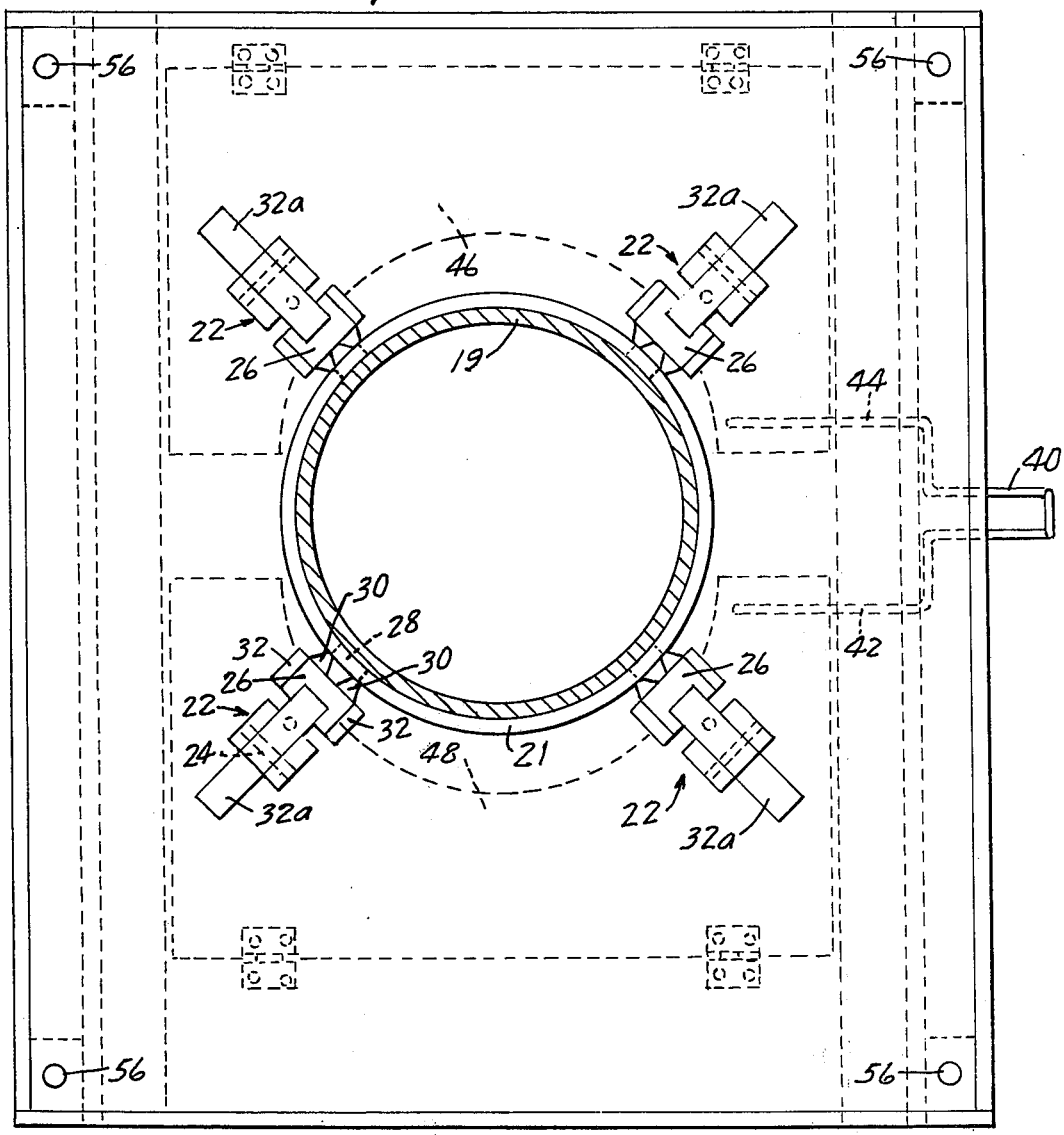
FIG. 3 is a cross-sectional view of the apparatus of FIG. 1 taken along line 3—3.

In FIG. 4 there is shown a sectional view of the apparatus of the invention during operation. In this figure the upper pipe section 19 is being turned out of coupling 21 by means of drive gear 50. The bottom of coupling 21 is resting on the projecting lips 28 of clamps 22 and is accordingly prevented from falling down into the casing 18. Clamps 22 also prevent rotational movement of coupling 21. Accordingly, as drive gear 50 is turned in a counterclockwise manner, gripping arms or dogs 80 cause the upper pipe section 19 to be turned out of the threaded coupling 21. As this occurs, the frame 54 (in which drive gear 50 is retained) must move upward along with pipe section 19. Upward vertical movement of frame 54 is permitted because frame 54 has slots or cavities 58 in its corners which accommodate rods 56 (which in turn are supported by platform 16). Thus, the upper pipe section 19 is turned out of the coupling by rotational movement of drive gear 50. If it is desired to turn the pipe section into coupling 21, the drive gear 50 is simply caused to turn in the opposite direction.

In order to keep frame 54 from sliding down rods 56 after a pipe section has been unthreaded from a coupling, a spring biased ball bearing catch 92 supported on frame 54 is adapted to roll or slide into a notch 94 on rod 56. One of these catches 92 is located at each corner of frame 54. The spring biased force which urges the ball bearing into one of the notches may be increased or decreased by turning nut 93 either clockwise or counterclockwise. Because the ball bearing is urged into the notch 94 by means of a spring, the ball bearing will also be urged out of notch 94 when the downward force on frame 54 becomes sufficiently great. Thus, when the drive gear 50 is being used to thread a pipe section into a coupling the downward force exerted on frame 54 will be sufficient to force the ball bearing out of notch 94 automatically.

Figure 6:
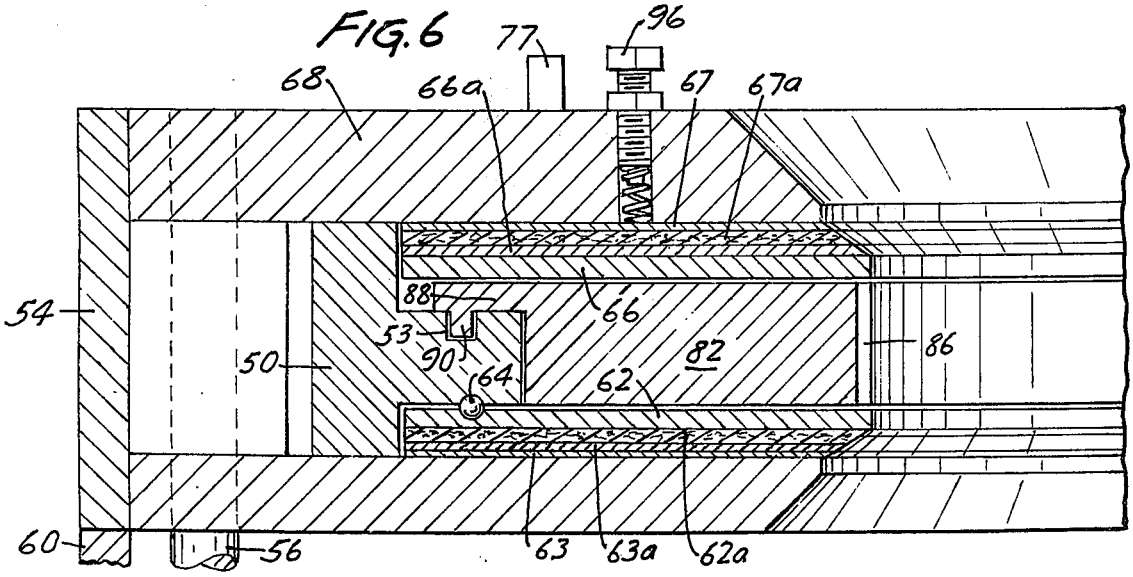
FIG. 6 is an enlarged view of a portion of the apparatus shown in FIGS. 2 and 4 which more clearly shows the drive gear mechanism.

In FIG. 6 there is shown an enlarged view of a portion of the drive gear means 50 in frame 54. The rear portion 88 of gripping arm 80 is attached to drive gear 50 by means of follower means 90 resting in guide means 53.

Drive gear 50 is sandwiched between an assemblage of plates which have a diameter smaller than the diameter of the gear. Drive gear 50 is supported on plate 62 by means of ball bearings 64. On the underside of plate 62 is a brakelining pad **62*a* which rests against wear plate 63a fastened to plate 63. Over drive gear 50 is a plate 66 over which a wear plate 66*a* is fastened. A brakelining pad 67*a* rests over plate 66*a* and is fastened to top plate 67. Plate 62 and plate 66 are each connected solidly to blocks 34 in areas between gripping dogs 80. Upon tightening pressure screw 96 mounted in cover plate 68, brakelining 67*a* and brakelining 62*a* are simultaneously forced against respective wear plates 66*a* and 63*a* so that the gear 50 may turn while the dogs cannot. As a result, the follower means 90 is caused to follow the curved path of guide means 53 until it reaches one end thereof. At that point the dogs are forced to turn in unison with the gear 50** and the friction provided by the pressure plates is overcome. Thus, by means of the pressure plate assembly the gripping dogs or arms are caused to follow the curved guide means so as to force the dogs to move against a pipe section or to move away from a pipe section. In this manner the apparatus is controlled so that it can be used to engage or disengage pipe sections and couplings.

Other variants are possible within the scope of the present invention.

What is claimed is:

1. Apparatus for coupling and uncoupling pipe sections at the head of a well casing, said apparatus comprising:

a. a base member adapted to support a platform over the head of a well casing, said platform having an opening therein which is adapted to permit said pipe sections to pass therethrough;

b. a plurality of self-engaging clamps supported on said platform around the periphery of, and projecting slightly over, said opening, said clamps being supported in a manner such that force exerted upwardly thereagainst by a pipe coupling in said opening effects disengagement of said clamps with respect to said pipe coupling but force exerted downwardly against said clamps will effect self-engagement thereof with respect to the periphery of said pipe coupling to prevent further downward movement, and rotational movement, of said coupling;

c. means for preventing self-engagement of said clamps with respect to said pipe coupling;

d. drive gear retaining means above said base and platform, said retaining means being supported in such a manner that rotational movement with respect to said platform is restricted while upward vertical movement is permitted, e. drive gear means supported by said retaining means, said gear means being aligned over said opening in said platform, said gear means having a plurality of gripping arms in the center thereof adapted to grip a pipe section therein and cause rotational movement of said pipe section with respect to said coupling;

f. power means operatively associated with said drive gear means for effecting rotational movement thereof.

2. Apparatus in accordance with claim 1, wherein said self-engaging clamps are hingeably supported on said platform.

3. Apparatus in accordance with claim 1, wherein said self-engaging clamps have teeth on the inward face thereof.

4. Apparatus in accordance with claim 1, wherein said self-engaging clamps have a projecting lip on the bottom thereof.

5. Apparatus in accordance with claim 2, wherein said means for preventing self-engagement of said clamps comprises means for causing upward movement of the inward portion of said clamps.

6. Apparatus in accordance with claim 1, wherein rotational movement of said retaining means is prevented by means of a plurality of upwardly projecting rods, supported by said platform, whch are receivably engaged by said retaining means.

7. Apparatus in accordance with claim 1, wherein said drive gear means has teeth around the periphery thereof.

8. Apparatus in accordance with claim 1, wherein said gripping arms are each attached to said drive gear by means of a follower means disposed in a curved guide means in said drive gear.

9. Apparatus in accordance with claim 1, wherein said power means is operatively associated with said drive gear means by means of a worm gear.

* * * * *